United States Patent [19]

Whetstone et al.

[11] Patent Number: 4,638,640

[45] Date of Patent: Jan. 27, 1987

[54] ICE THICKNESS CONTROLLER FOR AN ICE MAKING MACHINE

[75] Inventors: Wayne L. Whetstone, Winona; Fredrick W. Tryan, Lewiston, both of Minn.

[73] Assignee: Lake Center Industries, Winona, Minn.

[21] Appl. No.: 791,365

[22] Filed: Oct. 25, 1985

[51] Int. Cl.[4] ..... F25C 1/00

[52] U.S. Cl. ..... 62/139; 340/580

[58] Field of Search ..... 62/138, 139, 140, 128, 62/129, 135, 136, 137, 201; 340/580

[56] References Cited

U.S. PATENT DOCUMENTS

| | | | |
|---|---|---|---|
| 1,449,458 | 3/1923 | Sutermeister | 62/136 X |
| 1,940,473 | 12/1933 | Vogt | 62/136 |
| 2,229,181 | 1/1941 | Leilich | 62/140 |
| 2,901,741 | 8/1959 | Moore et al. . | |
| 3,769,809 | 11/1973 | Robinson et al. . | |
| 3,810,386 | 5/1974 | McAshan, Jr. . | |
| 4,497,181 | 2/1985 | Kocher et al. | 62/139 |

*Primary Examiner*—Harry Tanner

*Attorney, Agent, or Firm*—Kinzer, Plyer, Dorn & McEachran

[57] ABSTRACT

An ice thickness controller is used to monitor the ice thickness in a refrigeration system. The system has a compressor connected to evaporator tubes which are submerged in a container of water. A DC motor has a shaft extending below the water line in the container. The motor is periodically turned on and a sensing circuit monitors the motor current. If the ice bank in the container is at the correct thickness, the motor shaft will be frozen into the ice. The current draw of the stalled motor will be high with the result that the sensing circuit will turn the compressor off. If the ice bank thickness is low, the motor shaft is free to rotate, so the motor current will be low and the sensing circuit will turn the compressor on.

8 Claims, 3 Drawing Figures

D5 IN4004
R12 68Ω 5W
R13 10K
R22 47K
C7 10μf 35V ±10%
ICE SENSOR 20
FROM VOLTAGE REGULATION 12
C8 .022μf 50V
32
34
38
36
40
OUT +24V (B)
FROM ICE SENSOR DRIVER (BUFFER) 18
42
TO COMPRESSOR
COMPRESSOR CYCLE SWITCH 28
LOAD SENSOR AND LATCH 22
(A)
D6 IN4004
44
46
(B) +24V
DELAY TIMER 24
R16 20K
TO SAMPLE RATE SELECT 16
R15 10K
C9 .022μf 50V
R17 100K
Q2 2N4401
U1
C10 22μf 35V
Q1 2N4401
COMPRESSOR CONTROL 26
(B) +24V
R18 100K
R19 100K
C11 .022μf 50V
VOLTAGE REFERENCE 30
R21 100K
+24V (B)
FROM ICE SENSOR DRIVER (BUFFER) 18
R 20 10K
Q3 2N4401

ICE THICKNESS CONTROLLER FOR AN ICE MAKING MACHINE

SUMMARY

This invention relates to a controller for an ice making machine. It is particularly concerned with controlling the thickness of an ice bank in a soft drink dispenser.

A primary object of the invention is a controller for detecting and controlling the thickness of an ice bank that forms around submerged evaporator tubes of a refrigeration system.

Another object of the invention is a controller of the type described which controls ice thickness by monitoring the input current to a DC motor.

A further object of the invention is a controller of the type described which samples the ice thickness on an intermittent basis.

Another object of the invention is a controller which tests the ice thickness intermittently, with the rate of sampling being variable, depending on whether the compressor is on or off.

These and other objects will become apparent in the following specification, drawings and claims.

The ice thickness controller is intended to detect and control the thickness of an ice bank that forms around evaporator tubes submerged in a container of water. The controller is for use within self-contained commercial beverage cooler dispensers which employ hermetic refrigerant motor compressors and air or water cooled condensers. The controller will monitor the ice formation and regulate the compressor as ice forms around the freezing evaporator tubes. When the desired thickness is obtained, the controller will automatically turn the compressor off. The compressor is subsequently turned on as required to maintain a uniform ice thickness.

The controller consists of a motor bracket assembly and an electronic sensor control. The motor bracket assembly consists of a small DC motor, a six-inch extension shaft and a stainless steel shaft support bracket. This assembly is installed in such a manner that allows the extension shaft and shaft support to come in contact with the ice that forms around the evaporator tubes of the refrigeration system. The DC motor, of course, remains above the water line.

The control circuit periodically turns the motor on for a short period of time. If ice is not present at the motor shaft, the motor runs at normal speed with a low current draw. Under such conditions, the compressor is turned on to build up the ice bank. When the ice bank reaches the correct thickness, the motor shaft will be frozen into the ice. When the motor is subsequently turned on, which causes the motor current to increase to three to four times the normal current, a current sensing circuit senses the motor stall condition and then shuts down the compressor. The compressor will remain off until the ice melts away from the motor shaft.

DETAILED DESCRIPTION OF THE INVENTION

Figure 1:
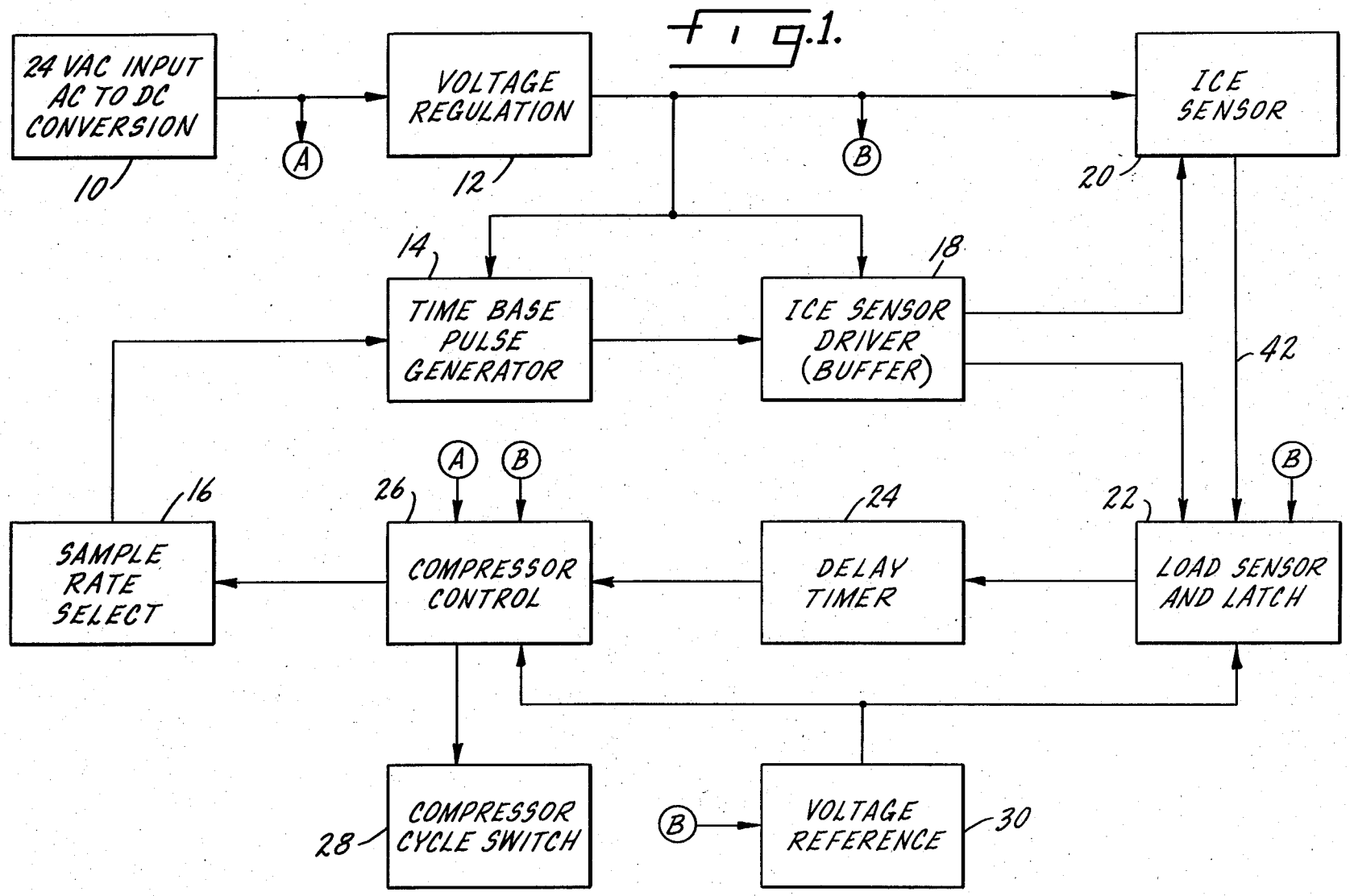
FIG. 1 is a block diagram of the ice thickness controller of the present invention.

A block diagram of the ice thickness controller is shown in FIG. 1. The controller is intended for use with a self-contained commercial beverage cooler dispenser having a compressor and evaporator. The evaporator tubes are submerged within a container of water. The controller monitors the ice bank and regulates the compressor as ice forms around the evaporator tubes.

The controller has a power supply which accepts a 24 VAC input. An AC to DC converter 10 provides DC current to a voltage regulator 12, which in turn supplies power to the remainder of the circuit. Unregulated power is supplied from the converter 10 to the compressor control, as indicated by the connecting symbol A.

A time base pulse generator 14 generates an intermittent sampling pulse. The frequency of the sampling pulse is controlled by a sample rate select 16. The duration of the sampling pulse is preferably about one to three seconds. The sampling pulse is fed to an ice sensor driver or buffer circuit 18. The ice sensor buffer 18 is connected to an ice sensor circuit 20 and to a load sensor and latch circuit 22. The ice sensor 20 includes a large capacitor and a DC motor connected to the voltage regulator 12. The motor has a shaft extending below the water line in the water container. The motor shaft is allowed to freeze into the ice when the ice reaches a desired level. The voltage developed across the motor provides an ice level signal which is fed to the load sensor and latch circuit 22. The load sensor 22 is responsive to the ice level signal to generate and maintain a compressor control signal, which in turn is fed to a delay timer 24. The compressor control signal is delayed about one to two seconds to prevent transients from affecting the circuit operation. The compressor control signal is then fed to the compressor control circuit 26. The compressor control circuit 26 operates a compressor cycle switch 28 which is a relay used as an in-line switch to control power to the compressor. The controller is completed by a voltage reference 30 which sets up a steady reference voltage for comparison purposes.

The sample rate select 16 controls the timing mode of the time base pulse generator 14 by monitoring the state of the compressor control 26. A one to three minute sample rate is selected when the compressor cycle relay is de-energized, i.e., the compressor is off. A ten to fifteen minute sample rate is selected when the relay is energized, i.e., the compressor is on.

When the time base pulse generator 14 generates a sampling pulse, the pulse is buffered by the ice sensor driver or buffer 18. The driver simultaneously turns on the ice sensor 20 including the DC motor to sample the ice thickness, and disables the load sensor and latch 22 for the duration of the sampling pulse. When the sampling pulse ends, the ice sensor driver 18 turns the ice sensor motor off and enables the load sensor and latch 22.

While the ice sensor motor is on, the ice sensor capacitor will charge up to the voltage level developed across the motor. This voltage level will then be used by the load sensor and latch 22 when the motor is turned off. The load sensor and latch 22 reads the ice sensor capacitor voltage and compares it to a steady reference voltage provided by the reference 30. If the capacitor voltage is less than the reference voltage, the load sensor's output will latch to a low state when enabled by the ice sensor driver 18. The output will similarly latch to a high state if the capacitor voltage is greater than the reference voltage.

The delayed compressor control signal triggers a toggle gate in the compressor control 26 that controls the compressor cycle switch relay 28. The relay is used to interface the electronic PC board to the compressor. When the compressor control signal is greater than the reference voltage, the toggle gate in the compressor control circuit 26 energizes the relay coil and closes the relay contacts. When the compressor control signal is less than the reference voltage, the toggle gate de-energizes the relay coil and opens the relay contacts. Thus, the controller maintains the compressor in operation for the period of time required to maintain the desired ice bank level.

Figure 2A:
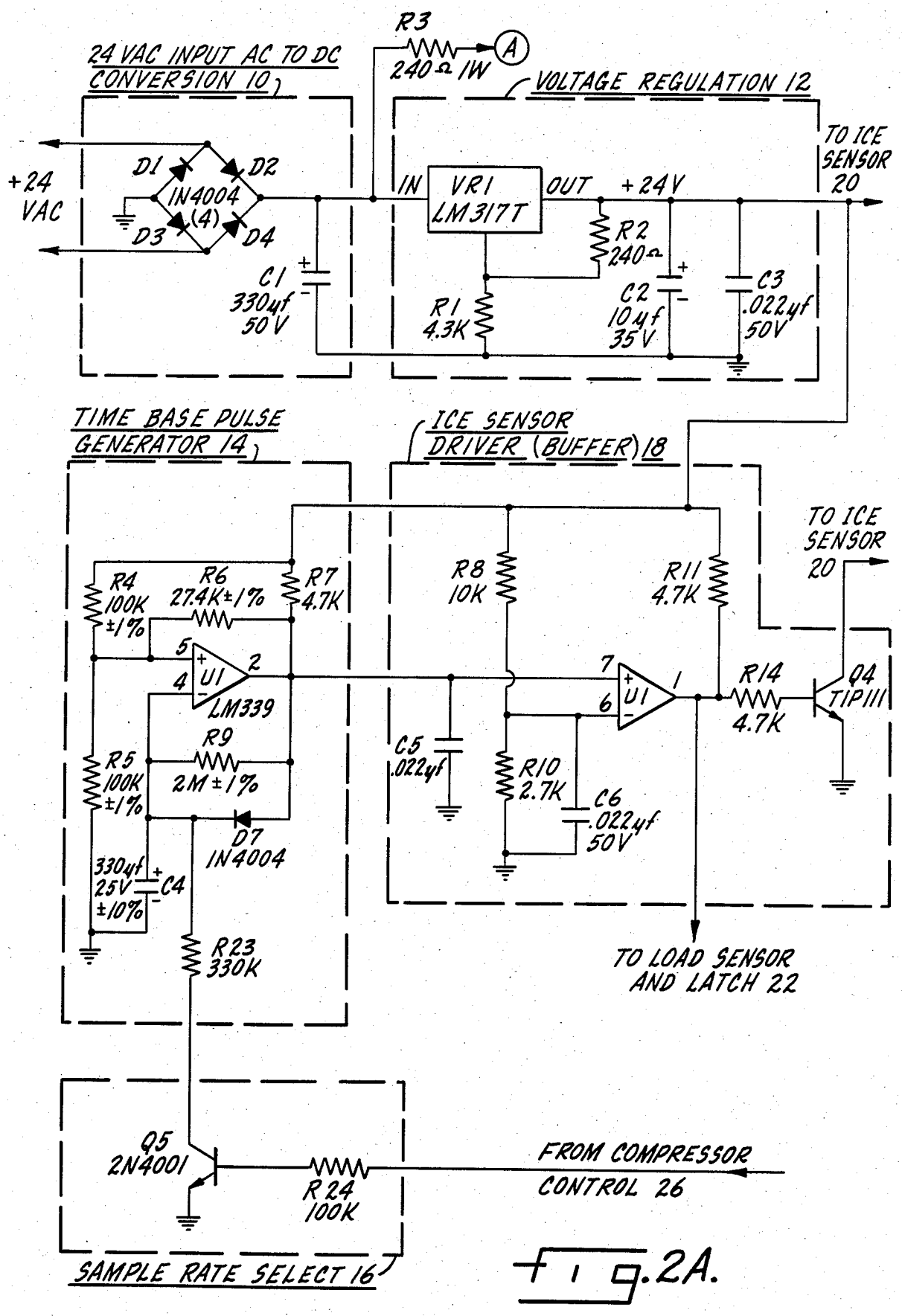
FIGS. 2A and 2B combine to form a schematic circuit diagram of a preferred embodiment of the invention.
Figure 2B:
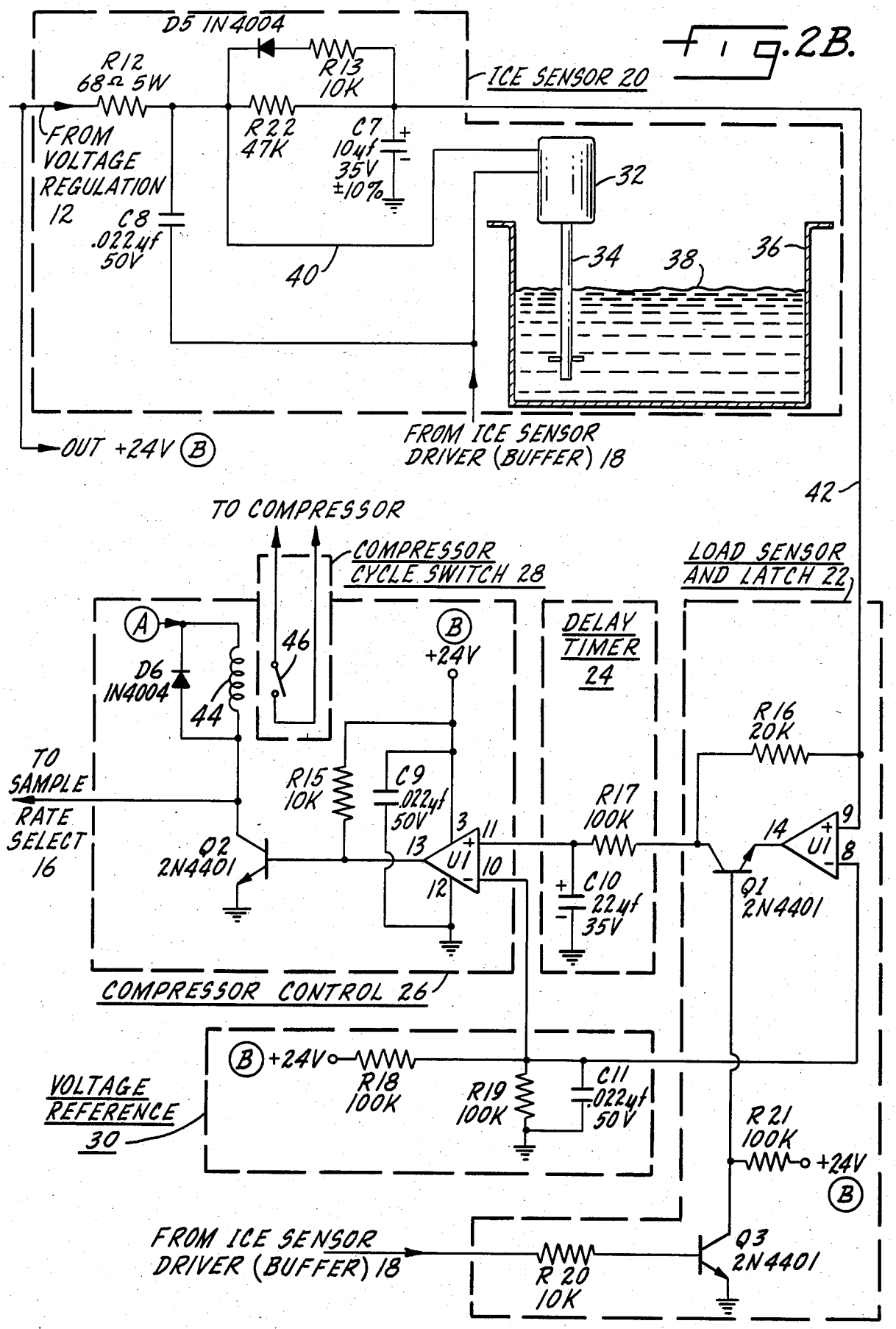

A specific embodiment of the block diagram of FIG. 1 is shown in FIGS. 2A and 2B. The AC to DC converter 10 includes a full wave rectifier incorporating diodes D1, D2, D3 and D4. The voltage regulator 12 has a 24 volt regulator VR1. The power supply is filtered by capacitors C1, C2 and C3.

The time base pulse generator 14 is essentially an RC circuit, utilizing capacitor C4. The comparator LM339 is a portion of a quad comparator integrated circuit. The other comparators used in the circuit are also a portion of the same integrated circuit. The sample rate select 16 uses transistor Q5 to alter the RC circuit in the time base pulse generator. Q5 is controlled by the status of the compressor control circuit 26. The output from the comparator pin 2 is supplied to the ice sensor driver or buffer 18. The comparator at pins 6, 7 and 1 is a high impedance buffer which drives the Darlington transistor Q4. This transistor turns the DC motor on and off.

Turning now to FIG. 2B, the ice sensor circuit 20 includes the DC motor, illustrated schematically at 32. It has an extension shaft 34 extending into the water container 36. The shaft extends below the water line 38. DC power is supplied to the motor through line 40. Capacitor C7 charges up to the voltage level developed across the motor 32 when the motor is turned on. This voltage level is fed to the load sensor and latch circuit 22 through line 42. This is the ice level signal. The ice level signal is compared by the comparator at pins 8 and 9 with the reference voltage from the circuit 30. The comparator in the load sensor 22 will latch to a low state if the ice level signal is less than the reference voltage. The compressor control signal will similarly latch to a high state if the ice level signal is greater than the reference voltage. The output on pin 14 is the compressor control signal.

The ice sensor buffer 18 disables the load sensor 22 during a sampling pulse by means of transistor Q3. When Q3 is conductive, transistor Q1 becomes nonconductive, thus disconnecting the output from pin 14. When the sampling pulse ends, the conditions of transistors Q3 and Q1 reverse so the compressor control signal is fed to the delay timer circuit 24.

The delayed compressor control signal triggers a toggle gate at pins 10, 11, 12 and 13, which in turn controls a transistor Q2. Transistor Q2 controls the coil 44 of the compressor cycle switch relay. The relay contacts 46 are normally open. When the compressor control signal is greater than the reference voltage, the toggle gate energizes transistor Q2, which in turn energizes the relay coil 44, causing the relay contacts 46 to close. When the compressor control signal is less than the reference voltage, the toggle gate de-energizes transistor Q2, and the relay coil 44, thereby opening the contacts 46. The relay coil 44 is driven by the unregulated DC voltage as shown at connector A.

Whereas a preferred form of the invention has been shown and described, it will be realized that modifications may be made thereto without departing from the scope of the following claims.

We claim:

1. In an ice making machine of the type having a compressor connected to evaporator tubes submerged in a container of water, an improved ice thickness controller, comprising:

a time base pulse generator for generating an intermittent sampling pulse;

an ice sensor circuit for generating an ice level signal, including a motor connected to a power supply, the motor having a shaft extending below the water line in the container, with the ice sensor circuit monitoring the motor current to develop the ice level signal;

a load sensor and latch circuit responsive to the ice level signal to generate and maintain a compressor control signal;

an ice sensor buffer responsive to the sampling pulse to turn the ice sensor motor on and disable the load sensor and latch circuit during a sample pulse and to turn the motor off and enable the load sensor and latch circuit in the absence of a sampling pulse; and a compressor control circuit responsive to the compressor control signal to turn the compressor on and off as needed to maintain the desired ice thickness in the container.

2. The controller of claim 1 further comprising a sample rate select circuit for increasing the sampling pulse frequency when the compressor is off.

3. The controller of claim 1 further comprising a delay timer circuit between the load sensor and latch circuit and the compressor control circuit, the delay timer preventing transients from affecting operation of the controller.

4. The controller of claim 1 wherein the power supply further comprises a voltage regulator providing a reference voltage.

5. The controller of claim 4 wherein the ice sensor circuit further comprises a capacitor which, when the motor is turned on, charges up to the voltage level developed across the motor, the capacitor charge representing the ice level signal.

6. The controller of claim 5 wherein the load sensor and latch circuit comprises a comparator which compares the ice level signal and the reference voltage, the circuit latching to a low state when the ice level signal is less than the reference voltage, and the circuit latching to a high state when the ice level signal is greater than the reference voltage.

7. The controller of claim 6 wherein the compressor control circuit comprises a toggle gate and a relay.

8. The controller of claim 7 wherein the toggle gate includes a comparator which compares the compressor control signal and reference voltage, energizing the relay coil and closing the relay contacts when the compressor control signal is greater than the reference voltage, and the comparator de-energizing the relay coil and opening the relay contacts when the compressor control signal is less than the reference voltage.

* * * * *